United States Patent [19]

Zocher

[11] 4,044,814

[45] Aug. 30, 1977

[54] METHOD OF FINLESS COLD FORMING OF SEWING MACHINE NEEDLE

[75] Inventor: Josef Zocher, AAchen, Haaren, Germany

[73] Assignee: The Singer Company, New York, N.Y.

[21] Appl. No.: 705,859

[22] Filed: July 16, 1976

[51] Int. Cl.[2] ..... B21G 1/04

[52] U.S. Cl. ..... 163/5

[58] Field of Search ..... 163/1, 2, 5

[56] References Cited

U.S. PATENT DOCUMENTS

| | | | |
|---|---|---|---|
| 3,589,428 | 6/1971 | Masujima | 163/5 |
| 3,861,446 | 1/1975 | Zocher | 163/5 |

*Primary Examiner*—Granville Y. Custer, Jr.
*Attorney, Agent, or Firm*—Edward L. Bell; Robert E. Smith; Julian Falk

[57] ABSTRACT

The method of fabricating a sewing machine needle is disclosed in which the needle blade including the long groove and the eye portion with a thin eye-accommodating web is cold formed in one finless flow pressing operation. The method of forming the needle orienting flat on the needle butt and laterally displacing the needle blade relatively thereto by a flow pressing operation is disclosed. A method of flaring the side flanges particularly in the eye portion to facilitate threading and a needle so constructed is also disclosed.

7 Claims, 10 Drawing Figures

Fig. 1
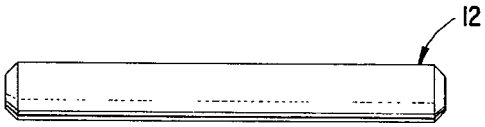
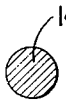
Fig. 3
Fig. 2
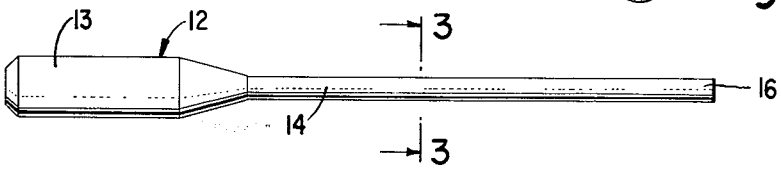
Fig. 4
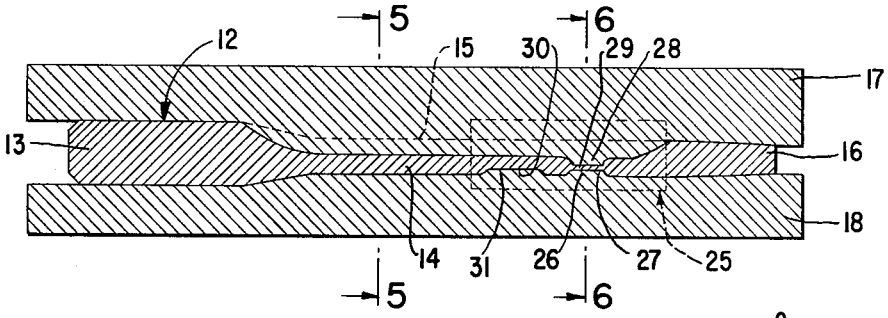
Fig. 5
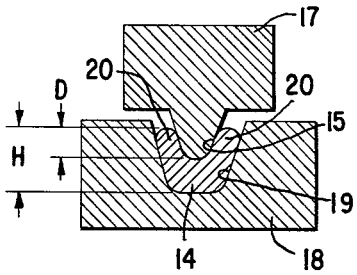
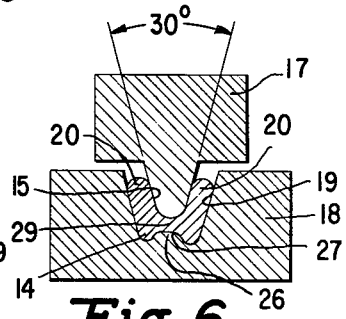
Fig. 6
Fig. 7
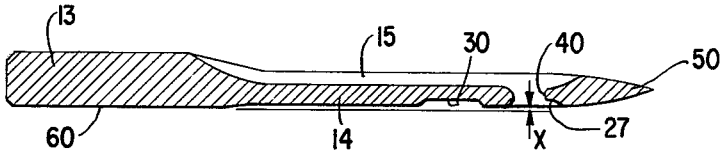
Fig. 8
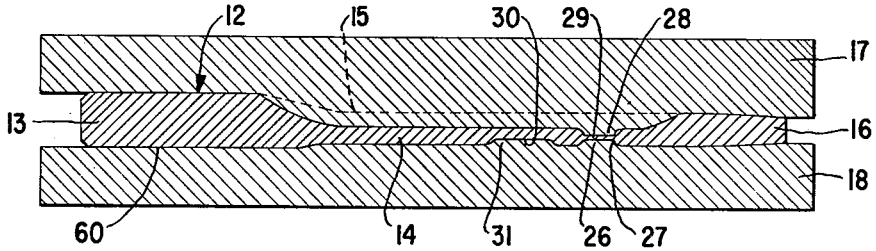
Fig. 10
(PRIOR ART)
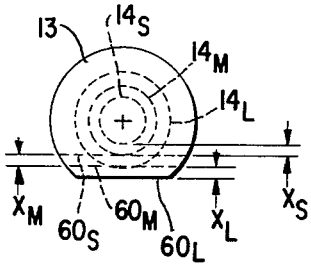
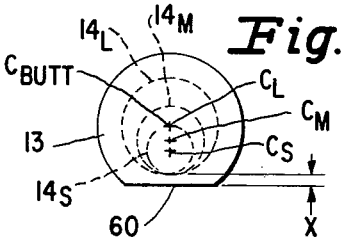
Fig. 9

METHOD OF FINLESS COLD FORMING OF SEWING MACHINE NEEDLE

BACKGROUND OF THE INVENTION

It is known in the manufacture of sewing machine needles to employ various machining or metal cutting steps, but these are slow and costly and invariably leave sharp edges which require extensive finishing steps.

Die pressing and flow pressing steps have also been used heretofore in the formation of needle blades, but these known pressing operations have either been combined with milling or cutting operations or have involved the use of a sequence of different pressing dies so that a number of operations at different work stations was involved requiring successive handling of the needles with consequent high cost.

SUMMARY OF THE INVENTION

It is an object of this invention to provide a method of sewing machine needle manufacture which reduces the expense and which produces needles of superior uniformity and high quality. This object of the invention is attained by the method of the present invention in which the entire blade portion of the needle is subjected to one finless flow pressing operation to form a continuous groove in the blade from the butt portion to closely adjacent the free extremity; and simultaneously, to form an eye portion along the continuous groove with a thin eye-accommodating web, following which the eye is punched through the web and the point is formed at the free extremity of the blade to finish the needle.

This invention also comprehends the further steps of cold forming the needle orienting flat on the needle butt and displacing the needle blade laterally of the butt by a flow pressing operation to obtain the required uniform offset of the eye portion laterally of the plane containing the flat on the butt.

This invention also includes the additional method step of flaring the needle side flanges particularly in the eye portion to facilitate needle threading.

DESCRIPTION OF THE DRAWING

In the accompanying drawing:

FIG. 1 is an elevational view of a blank of cylindrical stock suitable for the formation of one needle using the techniques of this invention, FIG. 2 is an elevational view of the blank of FIG. 1 on which the needle blade portion has been swaged to a smaller diameter in readiness for subsequent cold forming operation, FIG. 3 is a cross-sectional view taken substantially along line 3—3 of FIG. 2 and drawn at twice the scale of FIG. 2, FIG. 4 is a lengthwise cross-sectional view of the needle blank after the blade portion has been subjected to the influence of one set of flow pressing dies to form both the shank and eye portions simultaneously, and in which a representation of the opposing flow pressing dies is included, FIG. 5 is a cross-sectional view of the blade portion of the needle blank taken substantially along line 5—5 of FIG. 4, drawn at twice the scale of FIG. 4, and including a representation of the opposing flow pressing dies, FIG. 6 is a cross-sectional view of the blade portion of the needle blank taken substantially along line 6—6 of FIG. 4, drawn at twice the scale of FIG. 4, and including a representation of the opposing flow pressing dies, FIG. 7 is a lengthwise cross-sectional view of the finished needle after the eye has been punched, the point has been formed, and a needle orienting flat has been formed on the needle butt in predetermined lateral offset relation to the needle eye, FIG. 8 is a cross-sectional view similar to FIG. 4 but showing an arrangement in which the flat on the needle butt and the displacement of the needle blade with respect thereto is accomplished simultaneously by the same dies which shape the needle blade, FIG. 9 is an enlarged end elevational view taken from the butt end of the needle of FIG. 8 showing three different size needle blades to illustrate the uniform spacing thereof with respect to the plane of the flat on the needle butt, and FIG. 10 is an enlarged and elevational view of a typical prior art needle showing the manner in which uniform spacing of the needle blade with respect to the plane of the flat on the needle butt is obtained.

DETAILED DESCRIPTION

Referring to the accompanying drawing, FIG. 1 illustrates a cylindrical metal blank 12 suitable for the ultimate fabrication of a sewing machine needle by the operation of the method of this invention. FIG. 2 illustrates the shape of the blank 12 after it has been subjected to a swaging operation in which the blank 12 has been divided into a cylindrical butt portion 13 and a coaxial blade portion 14 of smaller diameter than the butt portion. FIG. 3 illustrates, at twice the scale, the cross-sectional shape of the swaged blade portion 14.

FIG. 4 is a lengthwise cross-sectional view of the swaged needle blank 12 after the blade portion 14 has been subjected to one finless flow pressing operation. By this flow pressing operation, a continuous long groove 15 is formed lengthwise in the needle blade from the butt portion 13 to a point adjacent to the free extremity 16 of the needle blade. FIG. 5 includes a representation of the cross-sectional shape of the flow pressing dies 17 and 18 along the needle blades 14 and it can be noted that the space between the needle blade accommodating cavity 19 in the bottom die 18 and the groove forming upper die 17 provides an excess of space of the cross-sectional area occupied by the needle blade so that room is provided for the needle blade to flow into the excess space between the dies 17 and 18.

It is to be noted that with this flow pressing operation, the formation of the groove 15 causes the metal of the blank to flow and causes flanges 20—20 to be raised one at each side of the groove 15. The depth D of the groove 15 can be made at least 40 percent of the transverse height H of the needle blade as shown in FIG. 5.

Referring again to FIG. 4, the flow pressing dies 17 and 18 encompass and influence the shape of the entire needle blade 14 including an eye portion indicated at 25 which is shaped simultaneously with the formation of the long groove 15 by the dies 17 and 18. FIG. 6 illustrates the cross-sectional shape of the needle blade at the eye and includes a representation of the dies 17 and 18 at this juncture. The bottom die 18 may be formed with a short groove forming projection 26 extending into the cavity 19 which serves to impress a short groove 27 into the needle blade at the opposite side from the long groove 15. The presence of the short groove 27 and the formation of an additional depression 28 in the long groove 15 by the top die 17, as shown in FIGS. 4 and 5, produces a thin eye-accommodating web 29.

Between the short groove 27 and the needle butt portion 13 a transverse scarf 30 can be pressed into the needle blade by inclusion of a suitable projection 31 in the bottom die 18 in order to provide clearance above the needle eye for passage of a sewing machine loop taker closer to the needle blade centerline better to sieze a loop of thread from the needle.

The dies 17 and 18 may also be formed so as to influence a slight taper to the free extremity 16 of the needle blade to facilitate later pointing of the needle.

Insofar as concerns the shape of the needle blade, the operation of the single set of flow pressing dies 17 and 18 completely forms the blade into final shape except for two operations, namely; the punching of the eye 40 which may be accomplished by a conventional eye punch, and the formation of the point 50 which may be accomplished by a grinding operation.

The absence of a fin as a result of the flow pressing operation eliminates sharp edges, burrs and the like and greatly facilitates furnishing of the needle by eliminating polishing and surface treatment steps.

It is pointed out that in the formation of the long groove 15 and particularly within the eye portion as illustrated in FIG. 6, the flanges 20—20 are preferably caused to diverge at an angle of at least 30° on that side occupied by the long groove. Since the long groove side is the side from which thread must be passed through the needle eye 40, this flared arrangement of the flanges 20—20 greatly facilitates threading of the needle.

In certain types of sewing machine needles, notably those intended for use of household sewing machines, it is common practice to provide the butt portion 13 with a noncircular configuration to aid in properly orienting the needle in the needle receiving clamp on the sewing machine needle bar. Although a variety of different noncircular shapes might suffice, the most commonly used shape involves the formation of a flat 60 on the butt. Heretofore, such flats have been formed by a grinding operation. Moreover, a fixed lateral offset exists on each sewing machine between the plane locating the needle butt flat and the path of the loop taken which seizes a thread from the needle blade. The offset from the flat 60 to the needle eye on the needle blade therefore should preferably be a constant X. In the prior art as shown in FIG. 10, this constant X is provided for in needles having varying diameter needle blades by grinding the flat deeper for needles with smaller diameter blades. In FIG. 10, three different needle blade diameters $\mathbf{14}_s$, $\mathbf{14}_m$, and $\mathbf{14}_l$ are shown together with correspondingly placed flats $\mathbf{60}_s$, $\mathbf{60}_m$, and $\mathbf{60}_l$ so that the offsets $X_s$, $X_m$, and $X_l$ will all be substantially equal.

This prior art procedure is not followed on the present invention, but instead the flat 60 is formed on the cylindrical needle butt 13 by a die pressing operation simultaneously with which the entire needle blade 14 is displaced laterally relatively to the butt portion 13, i.e. the central axis of the butt and blade portions are displaced so that the constant offset X of the needle blade relatively to the flat 60 is maintained throughout the entire range of needle blade sizes.

In FIG. 9 the arrangement of this invention is shown and the same three needle blade sizes $\mathbf{14}_s$, $\mathbf{14}_m$, $\mathbf{14}_l$ are illustrated being offset by the die pressing operation in varying degrees so as to preserve the constant offset X. In FIG. 9 the central axis of the needle butt is indicated at C butt and the central axis of the various size needle blades when properly displaced in accordance with this invention are marked $C_s$, $C_m$, and $C_l$ respectively.

The cold forming of the flat 60 on the needle butt and the displacement of the needle blade may be accomplished as a separate method step in the process of this invention either before or after the flow pressing operation is performed on the needle blade. FIG. 4 illustrates the flow pressing operation performed on the needle blade before the flat is formed on the butt so that a following pressing operation will be required to form the flat on the butt.

FIG. 8 illustrates a set of dies arranged to influence the formation of the needle blade 14 simultaneously with that of the flat 60 on the needle butt and displacement of the blade 14.

This invention provides for the reduction in production costs of needles in excess of 40 percent by reducing the number of different operations in needle production. The needles produced by the methods of this invention, moreover, are more uniform and follow more closely to predetermined dimension and form because difficult-to-control polishing, deburring, and grinding operations are largely eliminated. Furthermore, because of dimension uniformity sewing characteristics are improved.

Having thus set forth the nature of the invention, what we heretofore claim is:

1. The method of cold forming a finless sewing machine needle comprising a butt portion and a blade portion of reduced cross-sectional area extending from said butt portion to a free extremity, comprising subjecting said entire blade portion to one finless flow pressing operation to form a continuous groove in said blade portion from the butt portion to closely adjacent said free extremity, and simultaneously, to form an eye portion along said continuous groove having a thin eye-accommodating web, punching an eye hole through said eye-accommondating web, and forming a point at the free extremity of said blade portion.

2. The method of cold forming a finless sewing machine needle as set forth in claim 1 in which raised flanges are defined one at each side of the continuous groove formed by said single flow pressing operation, and including the further step of deforming said flanges at least in said eye portion to diverge at an angle of at least 30° on the side occupied by said long groove.

3. The method of cold forming a finless sewing machine needle as set forth in claim 1 including the further step of subjecting the needle to a subsequent die pressing operation to deform the butt portion into a noncircular cross-sectional configuration.

4. The method of cold forming a finless sewing machine needle as set forth in claim 1 including the further step of subjecting the needle to a subsequent die pressing operation to form a needle orienting flat on the butt portion.

5. The method of cold forming a finless sewing machine needle as set forth in claim 4 including the further step of subjecting the needle to a subsequent die pressing operation to displace the blade and butt portions relatively to each other and to space the needle blade at a predetermined distance laterally from a plane containing the flat on the butt portion.

6. The method of forming a sewing machine needle from a cylindrical blank, comprising subjecting a portion of said cylindrical blank to a swaging operation to define a cylindrical butt portion and a coaxial cylindrical blade portion extending from said butt portion to a free extremity, said blade portion being of substantially uniform cross-sectional diameter smaller than that of said butt portion, subjecting the entire swaged blank to one flow pressing operation to form a continuous groove in said blade portion from said butt portion to closely adjacent said free extremity, and simultaneously, to form an eye portion along said continuous groove having a thin eye-accommodating web, punching an eye hole through said eye-accommodating web, forming a point at the free extremity of said blade portion, and subjecting the needle to a die pressing operation to deform the butt portion into a noncircular cross-sectional shape having a predetermined orientation relatively to said blade portion.

7. The method of forming a finless sewing machine needle comprising a butt portion and a blade portion of reduced cross-sectional area extending from said butt portion to a free extremity, comprising subjecting said entire needle to a single flow pressing operation simultaneously to form a flat on said butt portion, to form a continuous groove in said blade portion from the butt portion to closely adjacent said free extremity, to form an eye portion along said continuous groove having a thin eye-accommodating web, and to orient said blade portion laterally a predetermined distance from a plane containing the flat on said butt portion, punching an eye hole through said eye-accommodating web, and forming a point at the free extremity of said blade portion.

* * * * *